United States Patent [19]

Dekker

[11] Patent Number: 4,467,491

[45] Date of Patent: Aug. 28, 1984

[54] REVERSIBLE HAIR AND CLOTHING BRUSH

[76] Inventor: Paul R. Dekker, Beethovenstraat 9, 1077 HL Amsterdam, Netherlands

[21] Appl. No.: 496,944

[22] Filed: May 23, 1983

[51] Int. Cl.[3] ..... A46B 7/02

[52] U.S. Cl. ..... 15/106; 15/114; 15/185; 15/203; 132/121

[58] Field of Search ..... 15/106, 114, 201, 202, 15/203, 184, 185; 132/121

[56] References Cited

U.S. PATENT DOCUMENTS

| | | | |
|---|---|---|---|
| 2,604,649 | 7/1952 | Stephanson et al. | 15/203 X |
| 4,057,867 | 11/1977 | Ballin | 15/185 |
| 4,346,496 | 8/1982 | Murray | 15/203 X |

FOREIGN PATENT DOCUMENTS

| | | | |
|---|---|---|---|
| 1408508 | 10/1975 | United Kingdom | 15/185 |

*Primary Examiner*—Peter Feldman

*Attorney, Agent, or Firm*—Fleit, Jacobson, Cohn & Price

[57] ABSTRACT

A combination hair and clothes brush which exposes only one brush for use at a time, the other brush being folded within the cavity of the body.

3 Claims, 10 Drawing Figures

1
2
3
4
5
9
10
11
12
13
14
15
16
A
B

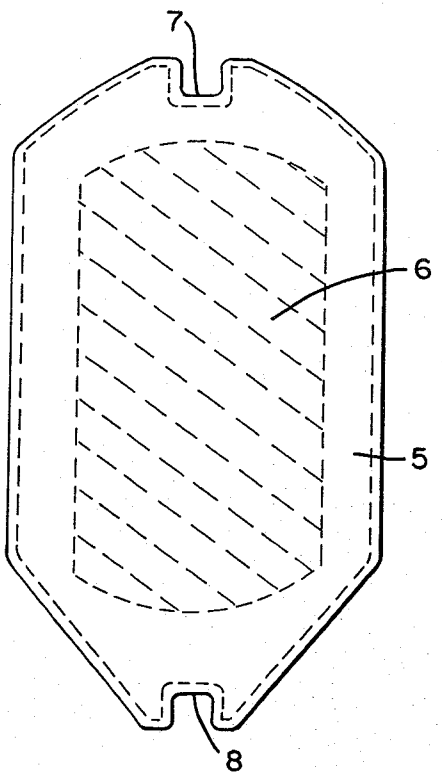
FIG. 7
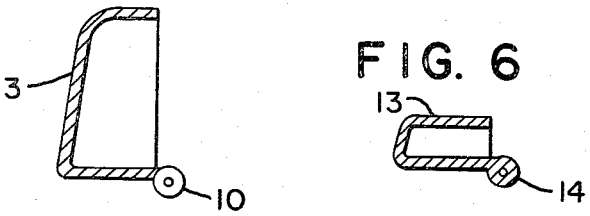
FIG. 5
FIG. 6
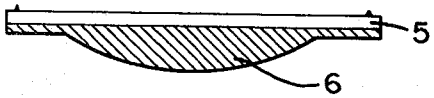
FIG. 8
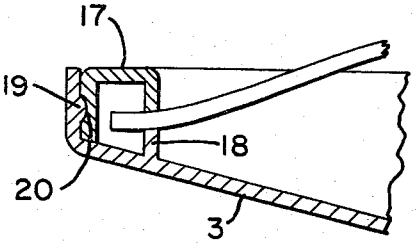
FIG. 9
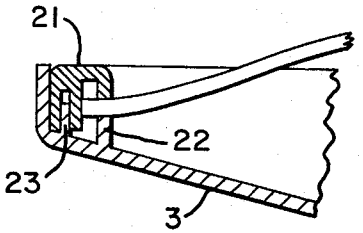
FIG. 10

REVERSIBLE HAIR AND CLOTHING BRUSH

BACKGROUND OF THE INVENTION

Standard hair brushes are well known in various designs and styles. Similarly, brushes are known for the removal of particles of dust and dirt from clothing. The cleaning surface of a clothes brush is of a velvet-like material capable of collecting particles by stroking in one-direction and discharging these particles by a single stroke in the opposite direction from the cleaning stroke. Typically, this invention is suited for travel or for carrying of a brush without the exposure of unsightly bristles.

As stated above, the choice of materials from which the components may be made is without limit. For example, the bristles of the brush may be plastic, metal or hair that has been strengthened for this purpose. The brush body, with or without a handle, may be made form hard plastics, wood, metal or a combination of these, plus any other material commonly used for a brush body.

SUMMARY OF THE INVENTION

This invention combines two different brushes in a compact, single unit. The brush is constructed such that by rotation of the handle around central pivot points, either the hair or clothes brush is exposed and the remaining brush is hidden within the body of the exposed brush. These types of brushes are suitable for use whenever compactness of size is a desired feature.

BRIEF DESCRIPTION OF THE DRAWINGS

FIG. 5 is a sectional view of FIG. 3 taken along the line A—A.

FIG. 6 is a sectional view of FIG. 3 taken along the line B—B.

FIG. 7 is a plan view of the hair brush surface.

FIG. 8 is a side view of FIG. 7.

FIGS. 9 and 10 are sectional views of different embodiments by which the edges of the hair and clothes brush are secured to the brush body.

DETAILED DESCRIPTION OF THE DRAWINGS

Figures 1, 2, 3, 4:
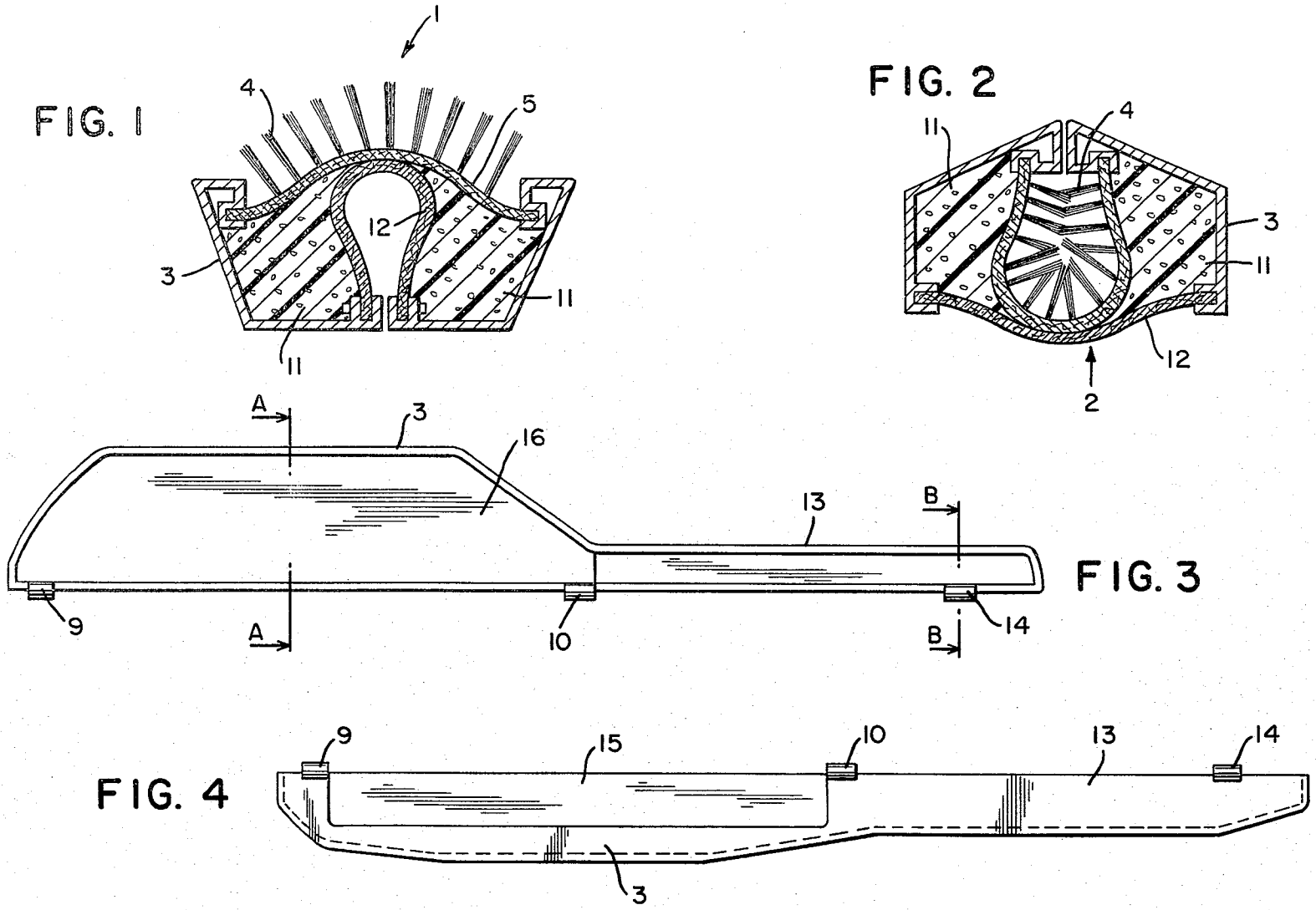
FIG. 1 is a sectional side view of the brush with the hair brush exposed.
FIG. 2 is a sectional side view of the brush with the clothes brush exposed.
FIG. 3 is a plan view of the brush body.
FIG. 4 is a side view of the brush body shown in FIG. 3.

FIG. 1 generally illustrates a hair brush 1 with a clothing brush, generally shown at 2, folded into the brush body 3. FIG. 2 illustrates the clothing brush 2 exposed while the bristles 4 have been folded in upon themselves.

FIG. 1 best shows bristles 4 inserted upon a brush bed 5. Brush bed 5 is a flexible material which is strong enough to hold bristles 4 during repeated use as a hair brush and flexible enough to be repeatedly folded. Every row of bristles 4 is offset from the other rows in order for the rows to be folded upon themselves without interferring with each other, as shown in FIG. 2. The spacing of the rows is dependent on the total number of rows used in the hair brush, which may vary. The bristles 4 may be either embedded in bed 5 or extend through the bed, being secured from beneath the bed surface.

FIG. 7 and 8 show brush bed 5, with the dotted lines shown along the periphery of the bed representing the area where the bed is secured within the body 3 of the brush. The central section of bed 5, shown in dotted lines, is liner 6. Liner 6 (not shown in FIG. 1) is a stiff supporting member, made of flexible material, such as plastic, although harder than bed 5. The liner acts as a support against the pressure applied to the bristles 4 during use, preventing movement of the bristles into the supporting bed 5. The two indentations 7 and 8 are provided to fit around pivotable hinges 9 and 10 (FIG. 3) respectively.

Between bed 5 and clothing brush material 12 is a cavity 11 which is filled with a supporting means (not shown), such as polyurethane, to provide a springy support to either hair brush 1 or clothes brush 2. The supporting means is subject to repeated compression but is resilient enough to maintain its shape. The amount of the supporting means should be limited to fill cavity 11 but not interfere with the movement of bed 5 and clothes brush material 12 when being reversed.

It should be noted that brush material 12, bed 5 and liner 6 are secured together by any suitable securing means such as heat sealing, glue, stitches or rivets. This aids in durability during constant changing of the two brushes.

Clothing brush material 12 is made of a material known to effectively remove lint from clothing such as velvet, cotton cloth or velour. It must however, be resilient enough to stand repeated folding and strong enough to stand the constant exposure of the surface during storage.

The body 3 of the brush is in two sections as shown in FIGS. 1 and 2. One of these sections is illustrated is FIGS. 3 through 6. The body may have handle 13 (FIG. 3, 4 and 6) or may not (not shown). Hinges 9, 10 and 14 may consist of a cylindrical piece with a pin extension on one side of the body insertable into a cylindrical piece with a central cavity. Any known pivoting device may be used in place of hinges 9, 10 and 14. The body sections are secured together by two clasps (not shown) consisting of a snap or other interfitting variety to lock the two sections together, when either brush is exposed. This is at a point along the body on the edges opposite those with hinges. Each section of the body, as best shown in FIG. 4, has an area 15 between hinges 8 and 10 which is indented. The clothing brush is positioned across the indented area 15 of FIG. 4, as shown in FIG. 2. Brush bed 5 is extended across the indented area 16 of FIG. 3, as shown in FIG. 1.

FIGS. 9 and 10 show several means of securing either the bed 5 of brush 1 or material 12 of brush 12 to the body 3. Securing clip 17 of FIG. 9 presses down on raised lip 18 and is secured by either by heat sealing, glue or pressure sealing at elevated temperatures to the inside surface of body 3. The inside of body 3 may be designed to have a slightly raised area 19 within which a corresponding depression 20 of clip 17 will fit. FIG. 10 illustrates clip 21 which fits over raised lip portions 22 and 23 of body 3. Clip 21 is held in place by either heat sealing, glue or pressure sealing at elevated temperatures. The securing of the body 3 to either bed 5 or material 12 may be one of the means outlined above which is suitable to hold bed 5 and material 12 in place over repeated folding, strong enough to securely hold bed 5 and material 12 taunt when either of them is the brush being used.

I claim:

1. A combination hair and clothing brush comprising a first brush with rows of bristles, said rows of bristles are separated and offset from one another a distance whereby folding of said bristles towards each other will not cause interference between said rows of bristles, a liner supports said bristles underlying a bed, said bristles are secured to said bed, a second brush with a cleaning material surface whereby dust and dirt are removed from an article by stroking in one direction, said dust and dirt are removed from said material by stroking against said article in the opposite direction of said first stroke, said cleaning material is a flexible, resilient material, a brush body which contains said first brush and said second brush, said brush body having two sections, said two sections are joined at one edge by pivoting means and are joined at an opposite edge by clasping means, said first brush and said second brush are secured to each other and both are secured to said brush body, a cavity formed between said first brush, said second brush and said brush body is filled with a resilient supporting means, whereby upon pivoting of said brush body sections around said pivoting means either of said first brush or said second brush is taunt and exposed and the other brush is unexposed and is folded within said brush body.

2. The brush of claim 1 further comprising said brush body with a brush handle.

3. The brush of claim 1 further comprising said first or second brush folded within said brush body form a U-shape.

* * * * *